US008317484B2

(12) United States Patent
Liebert et al.

(10) Patent No.: US 8,317,484 B2
(45) Date of Patent: Nov. 27, 2012

(54) OIL-INJECTED COMPRESSOR WITH A TEMPERATURE SWITCH

(75) Inventors: Konrad Liebert, Dachau (DE); Michael Schmid, Markt Indersdorf (DE); Nils Zieglgänsberger, München (DE); Karl Hering, Reichersbeuern (DE)

(73) Assignee: Knorr-Bremse System fur Schienenfahrzeuge GmbH, Munich (DE)

( * ) Notice: Subject to any disclaimer, the term of this patent is extended or adjusted under 35 U.S.C. 154(b) by 645 days.

(21) Appl. No.: 11/908,068

(22) PCT Filed: Mar. 8, 2006

(86) PCT No.: PCT/EP2006/002121

§ 371 (c)(1),
(2), (4) Date: Apr. 23, 2008

(87) PCT Pub. No.: WO2006/094781

PCT Pub. Date: Sep. 14, 2006

(65) Prior Publication Data

US 2009/0041589 A1 Feb. 12, 2009

(30) Foreign Application Priority Data

Mar. 9, 2005 (DE) ..... 10 2005 010 690

(51) Int. Cl.
*F04B 49/10* (2006.01)
*A62C 3/00* (2006.01)

(52) U.S. Cl. ..... 417/32; 169/54

(58) Field of Classification Search ..... 417/32, 417/44.1, 366; 418/94, 98; 164/87; 169/54, 169/87; *F04C 28/28*

See application file for complete search history.

(56) References Cited

U.S. PATENT DOCUMENTS

| | | | | |
|---|---|---|---|---|
| 4,551,719 | A * | 11/1985 | Carlin et al. | 340/825.36 |
| 5,099,976 | A * | 3/1992 | Jamison | 169/54 |
| 6,123,510 | A * | 9/2000 | Greer et al. | 417/53 |
| 6,139,280 | A * | 10/2000 | Holt et al. | 417/26 |
| 6,149,408 | A * | 11/2000 | Holt | 418/1 |
| 6,461,414 | B1 * | 10/2002 | Kohl et al. | 96/156 |
| 6,659,729 | B2 * | 12/2003 | Hattori et al. | 417/53 |
| 7,377,956 | B2 * | 5/2008 | Cheney et al. | 95/42 |
| 2003/0215336 | A1 * | 11/2003 | Hattori et al. | 417/53 |
| 2004/0004065 | A1 * | 1/2004 | Bankstahl et al. | 219/133 |
| 2004/0231357 | A1 * | 11/2004 | Matsuoka et al. | 62/470 |

* cited by examiner

*Primary Examiner* — Charles Freay
*Assistant Examiner* — Nathan Zollinger

(57) ABSTRACT

An oil-injected compressor, with an oil circuit for lubrication, and an oil separating device which is used to separate the oil from the compressed air. A self-resetting temperature switch, which is used to switch off the compressor unit when the maximum temperature limit of the incoming compressed air is reached, is provided in the region of the inlet of the compressed air, which contains oil, in the oil separating device. At least one non-self-resetting additional temperature switch is provided in the internal area of the oil separating device, which immediately switches off the compressor unit following a fire or an explosion of the compressed air, which contains oil, and which is contained in the oil separating device.

5 Claims, 1 Drawing Sheet

OIL-INJECTED COMPRESSOR WITH A TEMPERATURE SWITCH

BACKGROUND AND SUMMARY OF THE INVENTION

The present disclosure relates to an oil-injected compressor and in particular to an oil-injected screw-type compressor with a motor-powered compressor unit for production of compressed air. The compressor interacts with an oil circuit for lubrication, which is followed by an oil separator device for separation of the oil from the compressed air. A self-resetting temperature switch which switches off the compressor unit when the air/oil mixture flowing in reaches a maximum temperature limit, is provided in the area of the inlet of the compressed air containing oil into the oil separator device.

In addition to oil-injected screw-type compressors, the present disclosure is also used for other types of oil-injected compressors, for example, vane-cell compressors as well. In the case of compressors of the type that is of interest here, oil is injected by an oil circuit into the area of the moving compressor components, and on their bearing points. This lubricates the roller bearings, which are provided in this case and rotate at high speed, and prevents unacceptable heating in the area of the moving compressor components, as a result of friction. Furthermore, the oil is also used to seal the air side from other areas of the compressor. The use of oil-injected compressors such as these extends not only to stationary compressed-air supply installations, but also to mobile applications such as rail vehicle construction, or else to commercial vehicle construction where compressors are used to produce compressed air for the vehicle compressed-air supply system.

Oil-injected compressors, such as oil-injected screw-type compressors, are known from the general prior art. An oil-injected screw-type compressor essentially comprises a compressor unit with at least one pair of compressor screws in the form of rollers, rotating in opposite directions to one another, and intermeshing with one another. This compressor screw arrangement produces compressed air. Air, that is sucked in from the atmosphere from one side, is converted by continuous compression to compressed air, and leaves the compressor unit via a spring-reset outlet valve. The compressor screw arrangement is driven via a drive shaft which extends out of the compressor unit via a seal. A motor, which is flange-connected to it the drive shaft, may be an electric motor. In order to lubricate, seal and cool the compressor unit, it is equipped with an oil circuit starting from an oil sump, supplies oil to the central area of the compressor screw arrangement as well as to roller bearings which are arranged in the area of the end face of the compressor screw arrangement. The oil which is injected here leaves this active area in the direction of an oil sump, which represents the reservoir for the oil circuit. The oil sump is generally located within an oil separator device which follows the oil circuit. The oil separator device is necessary in order to remove the oil from the compressed air again, so that compressed air which is free of oil is available on the output side. Conventionally, the oil separator device is formed essentially from an oil separator which operates in a manner known per se, on the force of gravity principle. The oil, which is separated from the compressed air which contains oil and rises in the oil separator, is gathered in the oil sump. The compressed air which is already partially free of oil and rises in the oil separator is then generally supplied to a cartridge-like fine separator and then leaves the oil separator device via a pressure-maintenance valve arranged on the output side.

According to EN Standard 1012-1, it is not permissible for safe operation of an oil-injected compressor for the oil temperature to exceed 120° C. adjacent to the area in which the compressed air containing oil enters the oil separator device. A temperature switch is normally arranged in this area in order to comply with this Standard. The temperature switch switches on won reaching a temperature of 120° C. and stops the drive for the compressor unit, by switching off the motor. When the temperature falls into the range below 120° C. again, the drive for the compressor unit is enabled again.

U.S. Pat. No. 5,118,260 discloses a temperature switch for a screw-type compressor although, in this case, this is not in the form of an oil-injected screw-type compressor. The temperature switch is arranged at the outlet of the screw-type compressor within an outlet chamber. The compressed air which has been heated by the screw-type compressor flows past the temperature switch. The temperature switch contains an electrical bimetallic element which interrupts the drive to the screw-type compressor when the temperature of the compressed air that has been produced reaches a specific maximum value. In addition to this temperature switch, which is arranged in the area of the compressed air flowing out of the compressor unit, a further temperature switch is located in the area of the electric motor that drives the screw-type compressor, and protects the entire unit against motor overheating.

If a motor-powered compressor unit such as this is provided with oil injection, so that it is necessary to provide a downstream oil separator device in order to separate the oil from the compressed air, this results in the problem. Internal fires or detonations can occur sporadically, despite the measure explained above to prevent overheating within the oil separator device. A singular event such as this normally occurs downstream from the temperature switch, as required in accordance with the Standard cited initially, within the oil separator device. So far, the reason for such an internal fire or detonation has not clearly been explained. In specialist circles it is assumed that this event is the consequence of electrostatic discharges within the oil separator device, producing electrical sparks. Lack of servicing and, in particular, lack of oil can also be considered as detonation causes. A fire or a detonation results in temperatures in the oil separator device and downstream from it which are many times higher than the specified temperature limit of 120° C. Since the temperature on the inlet side of the oil separator device, in particular because of the physical proximity of the oil sump, is matched only slowly to the hot temperature level, the required temperature switch in the area of the compressed air flowing in cannot react sufficiently quickly to the event of a fire or detonation within the oil separator device, or downstream from it. A fire or detonation can result in the components of the oil separator device, which are occasionally also produced from aluminum, burning through. Furthermore, the bearing for the compressor screws can seize as a consequence of overheating or lack of lubrication. In the case of the gray-iron and cast-steel housings normally used, this can even lead to explosive destruction of the compressor. Furthermore, combustion residues also enter the exhaust air. In summary, this singular event can result in hazards to personnel and damage to the compressor as well as consequential damage, which therefore cannot be prevented, or at least limited by the temperature switch required by the Standard.

BRIEF SUMMARY OF INVENTION

The object of the present compressor is therefore to improve further an oil-injected compressor of the type mentioned initially so as to make it possible to cope with the negative effects of a fire or detonation within the oil separator device.

The present compressor includes the at least one non-self-resetting additional temperature switch in the internal area of the oil separator device downstream from an oil-injected compressor, and switches the compressor unit off without delay in response to a fire or a detonation of the compressed air which is contained in the oil separator device and contains oil. For the purposes of the present disclosure, the expression internal area of the oil separator device should be understood as meaning the large-volume internal area which contains the oil/air mixture and, in particular, also the outlet area of the compressed air, from which oil has been separated, from the oil separator device as far as, at most, the inlet to a recooler which may be connected downstream in the outlet flow direction.

The specific positioning of the additional temperature switch ensures that the compressor is rendered inoperative without delay in the event of an internal fire or detonation. Specifically, in the case of compressed-air compressors, this suppresses the oxygen supply, immediately quenching the fire and avoiding consequential damage. Pressure relief is also normally initiated, assisted by the shut down process. In summary, the process of shutting down the compressor immediately, extracts oxygen very quickly from the internal combustion process, quenching the fire. The additional temperature switch therefore renders the compressor inoperative quickly and permanently in the event of this event. This effectively prevents personnel injuries or total damage to the oil-injected compressor, as well as consequential damage. Since at least some of the components of the compressor will have already been damaged in this event, the compressor is rendered inoperative by the non-self-resetting additional temperature switch until suitable maintenance personnel have carried out a repair and operation of the oil-injected compressor can resume after a new temperature switch has been fitted.

The additional temperature switch should may be a fuse link, in order to ensure that the compressor is reliably reconnected only after the specialist repair. This is because a fuse link permanently interrupts the circuit bridged by the additional temperature switch and is reliably destroyed after initiation. This precludes accidental reconnection of the compressor unit. Furthermore, temperature switches in the form of fuse links are quite simple components which can be obtained as mass-produced items. They also include particularly quick-reaction fuse links which are particularly suitable for the application.

In order to ensure that the additional temperature switch is reliably initiated if the event occurs, it is positioned in the outlet area of the internal area, as defined above, of the oil separator device, in which the flow speed of the compressed air flowing out of it is normally high. A particularly rapid temperature rise can therefore be observed in this area in the event of a fire or detonation, and can then be reliably detected by the additional temperature switch. One particularly suitable location for arrangement of the additional temperature switch is in the area between a pressure-maintenance valve, which is normally arranged on the outlet side of the oil separator device, and an upstream fine separator unit. It is also optimal to arrange the additional temperature switch, on the outlet side, in the compressed air flow in the area immediately following said pressure-maintenance valve.

Extinguishants are additionally forced into the internal area of the oil separator device when the additional temperature switch trips. This results in the oil-injected compressor being shut down by switching off the drive. Generally known fire-retardant substances, which extract oxygen by an appropriate chemical reaction from their surrounding area when heated, are suitable for use as extinguishants. These substances may be in the form of powder, foam and the like.

An optical indication means can be provided, which signal the tripping of the additional temperature switch when the event occurs. Thus, a fire or a detonation within the oil separator device can be diagnosed without doubt by the maintenance personnel, thus allowing specific repair.

The present improvements are not intended solely for a single-stage, oil-injected compressor. It is accordingly possible for the compressor also to be in the form of a multistage compressor unit with each stage being followed by an oil separator device, in which case additional temperature switches will then be provided adjacent to the oil separator device for each compressor stage.

Further measures that represent improvements to the compressor will be described in more detail in the following text, together with the description of one preferred exemplary embodiment of the invention, and with reference to the figures.

DETAILED DESCRIPTION OF THE EMBODIMENT

Figure 1:
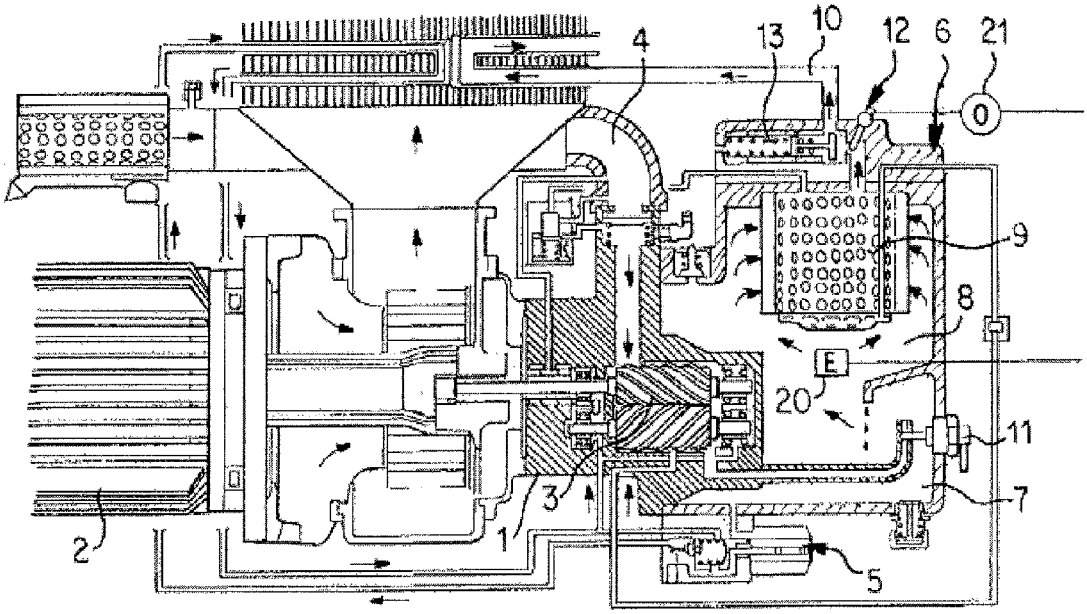
FIG. 1 shows a longitudinal section through an oil-injected compressor with a downstream oil separator device.
Figure 1A:
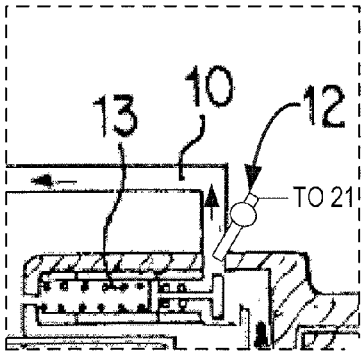
FIG. 1A shows an enlarged partial longitudinal section through the oil-injected compressor with a downstream oil separator device of FIG. 1 and the additional temperature switch for such device arranged immediately after the pressure-maintenance valve.

As shown in FIG. 1 an oil-injected screw-type compressor essentially comprises a compressor unit 1 which is driven by a motor 2. A compressor screw arrangement 3 is mounted within the compressor unit by roller-bearing arrangements such that it can rotate. The compressor arrangement 3 compresses air which is sucked in from the surrounding area via inlet channel 4 by the rotary movement produced by the motor 2. Oil for lubrication is injected from an oil circuit 5 in the axial central area of the compressor screw arrangement 3. Some of the oil which is required in this case for lubrication, cooling and sealing purposes is introduced into the compressed air leaving the outlet side of the compressor screw arrangement 3. An oil separator device 6 follows the compressor unit 1, in order to separate the oil from the compressed air.

The oil separator device 6 has an oil sump 7, in the area of which the compressed air which contains oil and is produced by the compressor unit 1 flows into the oil separator device 6. This flow is passed firstly into the area of an initial oil separator 8. The initial oil separator 8 separates oil by the force resulting from the effect of gravity. The oil separated in this way enters the oil sump 7. After passing through the initial oil separator 8, the compressed air, from which some of the oil has already been removed, enters a fine separator 9. The fine separator 9 is in the form of a cartridge and filters the compressed air, which is partially free of oil, radially inwards via the outer radial wall area. From here, the compressed air, which is now free of oil, is passed to an outlet 10 of the oil separator device 6 from where it is passed into the compressed-air system, which is not illustrated in any more detail.

A self-resetting temperature switch 11 is arranged in the area of the inlet for the compressed air, which contains oil and is produced by the compressor unit 1, into the oil separator device itself. The temperature switch 11 switches the motor-powered compressor unit 1 off if a limit temperature of 120° C. is exceeded. This is done by switching off the motor 2. This prevents the ingress of excessively hot compressed air containing oil into the oil separator device 6. When the temperature of the compressed air which contains oil and is flowing in falls below the stated temperature limit value, then operation of the compressor unit 1 is resumed.

An additional temperature switch 12 is provided in addition to this safety device 11, which prevents overheating, in the internal area of the oil separator device 6. The additional temperature switch 12 identifies a temperature rise initiated as a consequence of a fire or a detonation within the oil separator device 6 and then switches off the compressor unit 1 in order to prevent further consequential damage. For this purpose, and in contrast to the other temperature switch 11, the additional temperature switch is non-self-resetting in order to prevent operation from being resumed after the rare event mentioned.

In this exemplary embodiment the additional temperature switch 12 is arranged in the compressed-air flow in the area between an outlet-side pressure-maintenance valve 13 and upstream of the fine separator 9. This position of the additional temperature switch 12 is particularly suitable, since this is where the temperature rise occurs most rapidly as a result of the high flow speed of the compressed air flowing out and the proximity to the fine separator 9. Thus, the additional temperature switch 12 reacts very quickly. Alternatively, the additional temperature switch 12 may be positioned on the outlet side of the compressed air flow in the area immediately after the pressure maintenance valve 13.

Figure 2:
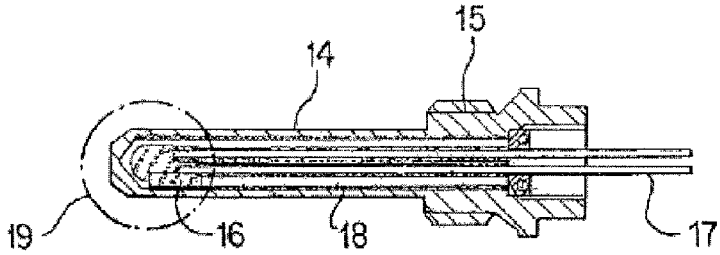
FIG. 2 shows a longitudinal section through an additional temperature switch for the oil separator device.

As shown in FIG. 2, the additional temperature switch 12 which is used for the exemplary embodiment described here comprises a pressuretight outer tube 14, at whose proximal end a screw union 15 is provided. The screw union 15 is used for screwing the temperature switch 12 into the housing of the oil separator device, which is not illustrated in any more detail here. A thermal fuse link 16 is accommodated at the distal end within the pressuretight tube 14 and opens when a maximum permissible limit temperature, which must be defined, is exceeded, thus interrupting the circuit formed via the two connecting lines 17. The interior of the pressuretight tube 14 is sealed with a filling compound 18. The non-self-resetting temperature switch 12 is located with its active area 19 within the compressed air flowing out of the oil separator device 6.

When the additional temperature switch 12 trips at the high temperature, a device 20 forces extinguishants into the internal area of the oil separator device 10. An optical indication means 21 signals that the additional temperature switch 12 has tripped. This provides information about the need to repair the oil separator device 6.

The present disclosure is not restricted to the exemplary embodiment described above. Modifications to it can also be covered by the scope of protection of the subsequent claims. For example, it is therefore also possible to use a different type of oil-injected compressor, such as a vane-cell compressor, provided this has a downstream oil separator device which, of course, does not need to be connected directly downstream from the compressor unit. Furthermore, the oil-injecting compressor unit may also be in the form of a multistage compressor unit with an oil separator device following each stage. In this case, it would be necessary to provide each oil separator device with an additional temperature switch according to the invention.

The invention claimed is:

1. An oil-injected compressor for production of compressed air, an oil circuit for lubrication of the oil-injected compressor, and an oil separator device for separation of oil from a compressed air/oil mixture and delivering a compressed air flow, the oil-injected compressor comprising:

a self-resetting temperature switch near an inlet of the oil separator device for the compressed air/oil mixture, the self-resetting temperature switch being configured to switch off the oil-injected compressor when the compressed air/oil mixture flowing into the inlet reaches a maximum temperature limit;

at least one additional non-self-resetting temperature switch in an internal area of the oil separator device which is configured to trip and switch the oil-injected compressor off in the event of a fire or detonation of the compressed air/oil mixture contained in the oil separator device;

wherein the additional non-self-resetting temperature switch is arranged near an outlet of the internal area of the oil separator device where the compressed air flow out of the oil separator device is at a high flow speed;

wherein the additional non-self-resetting temperature switch is arranged in the compressed air flow at the outlet between an outlet side pressure-maintenance valve and a fine separator of the oil separator device; and an extinguishant supply device configured to force extinguishants into the internal area of the oil separator device when the additional non-self-resetting temperature switch trips.

2. The oil-injected compressor of claim 1, wherein the additional non-self-resetting temperature switch is a fuse link.

3. The oil-injected compressor of claim 1, further comprising an optical indication means configured to signal the tripping of the additional non-self-resetting temperature switch.

4. The oil-injected compressor of claim 1, wherein the compressor unit includes a multistage compressor with an oil separator device following each stage and including a non-self-resetting additional temperature switch being provided on the oil separator device of each compressor stage.

5. An oil-injected compressor for production of compressed air, an oil circuit for lubrication of the oil-injected compressor, and an oil separator device for separation of oil from a compressed air/oil mixture and delivering a compressed air flow, the oil-injected compressor comprising:

a self-resetting temperature switch near an inlet of the oil separator device for the compressed air/oil mixture, the self-resetting temperature switch being configured to switch off the oil injected compressor when the compressed air/oil mixture flowing into the inlet reaches a maximum temperature limit;

at least one additional non-self-resetting temperature switch in an internal area of the oil separator device which is configured to trip and switch the oil-injected compressor off in the event of a fire or detonation of the compressed air/oil mixture contained in the oil separator device;

wherein the additional non-self-resetting temperature switch is arranged near an outlet of the internal area of the oil separator device where the compressed air flow out of the oil separator device is at a high flow speed;

a pressure-maintenance valve proximate the outlet, wherein the additional non-self-resetting temperature switch is arranged on an outlet side of the compressed air flow in an area immediately after the pressure-maintenance valve; and an extinguishant supply device configured to force extinguishants into the internal area of the oil separator device when the additional non-self-resetting temperature switch trips.

* * * * *